US005819458A

United States Patent [19]

Hadden

[11] Patent Number: 5,819,458

[45] Date of Patent: Oct. 13, 1998

[54] REINFORCED PICTURE FRAME MOULDING

[76] Inventor: David M. Hadden, 241 N. Clark Ave., Los Altos, Calif. 94022

[21] Appl. No.: 934,913

[22] Filed: Sep. 22, 1997

Related U.S. Application Data

[63] Continuation of Ser. No. 536,683, Sep. 29, 1995, abandoned.

[51] Int. Cl.[6] ..... G09F 1/12

[52] U.S. Cl. ..... 40/782; 40/700; 52/309.9; 52/734.1; 52/738.1

[58] Field of Search ..... 40/700, 768, 780, 40/782, 783; 52/309.9, 734.1, 738.1, 730.3, 309.7

[56] References Cited

U.S. PATENT DOCUMENTS

| | | | |
|---|---|---|---|
| 3,274,721 | 9/1966 | Dreyer | 40/771 |
| 3,856,257 | 12/1974 | Wetstone | 40/782 X |
| 4,462,176 | 7/1984 | Schovee | 40/700 |
| 4,795,666 | 1/1989 | Okada et al. | 52/309.9 X |
| 4,848,015 | 7/1989 | Allen | 40/740 |
| 4,864,789 | 9/1989 | Thorn | 52/309.9 |
| 5,057,350 | 10/1991 | Gezels | 108/901 X |
| 5,247,773 | 9/1993 | Weir | 52/309.9 X |
| 5,286,558 | 2/1994 | Seo et al. | 40/768 X |
| 5,404,663 | 4/1995 | Schober | 40/768 |
| 5,526,622 | 6/1996 | Augustine | 52/309.9 |

*Primary Examiner*—Brian K. Green
*Attorney, Agent, or Firm*—Flehr Hohbach Test Albritton & Herbert LLP

[57] ABSTRACT

A length of picture frame moulding which includes an elongate member extending the length of the picture frame moulding. An element is carried longitudinally by the elongate member for reinforcing the elongate member against bending.

34 Claims, 4 Drawing Sheets

REINFORCED PICTURE FRAME MOULDING

CROSS-REFERENCED TO RELATED APPLICATIONS

This application is a continuation of U.S. patent application Ser. No. 08/536,683 filed Sep. 29, 1995, now abandoned.

This invention relates to picture frame mouldings and more particularly to lightweight picture frame mouldings such as mouldings made from extruded foam.

DESCRIPTION OF THE PRIOR ART

Extruded cellular foam products have heretofore been used as wood substitutes in picture frames and architectural moulding. One of the disadvantages of free foam extruded profiles, however, is that the foam has a much lower modulus of elasticity than many woods and therefore tends to sag more than wood, particularly over time, when compared to identical wooden profiles. Foamed plastics are also softer than wood and thus relatively easy to dent and scratch.

The Celuka process developed some time ago provides a hard skin on the surface of extruded profiles as an integral part of the extrusion. Extrusions using the Celuka process tend to be somewhat more rigid and resistant to flex than free foam extruded profiles because the outer surface is solid and therefore has a higher modulus of elasticity than the interior foam. This process has overcome most of the dent and scratch problems of free foam extrusions, but the process costs are more and the extrusion speeds are slower when the Celuka method is compared with conventional free foam extrusions. In addition, precision control of the uniformity and thickness of the skin produced by the Celuka process is not possible. Nor is it possible to use one type of plastic for the skin and another for the core in the Celuka process. Furthermore, moulding constructed with the Celuka process is unacceptable for use over large unsupported spans with small cross-sectional profiles.

New extrusion and material technologies make it possible to coextrude two different plastic materials colinearly under highly controllable and accurate conditions. It is possible with these technologies to extrude a very hard solid exterior shell of plastic and simultaneously fill it with a foamed interior. Alternatively, exterior and interior shells can be extruded and the cavity between the shells simultaneously filled with foam. This process is currently being used to make thick walled plastic pipe. One of the advantages of the process is that it can run at almost twice the extruding speed of conventional extrusions incorporating the Celuka process. Another advantage is that the process can be applied to hollow profiles thus allowing material to be removed from portions of a profile's cross section so as to save on material.

OBJECTS AND SUMMARY OF THE INVENTION

It is in general an object of the invention to provide a new and improved picture frame moulding which is competitive in price and comparable in strength to many conventional wood mouldings.

Another object of the invention is to provide a picture frame moulding of the above character which includes an elongate member extruded from a foam material.

Another object of the invention is to provide a picture frame moulding of the above character in which a reinforcing element is carried by the elongate member along the length thereof for increasing the stiffness of the picture frame moulding.

Another object of the invention is to provide a picture frame moulding of the above character in which the reinforcing element includes a shell secured to the outside of the elongate member.

Another object of the invention is to provide a picture frame moulding of the above character in which the elongate member is hollow and the reinforcing element includes a shell secured to the inside of the elongate member.

Another object of the invention is to provide a picture frame moulding of the above character in which the reinforcing element includes a metal strip.

Another object of the invention is to provide a picture frame moulding of the above character in which the metal strip is carried inside the elongate member.

Another object of the invention is to provide a picture frame moulding of the above character in which the reinforcing element strengthens the elongate member against bending about the transverse axes of the elongate member.

Another object of the invention is to provide a corner assembly for easily securing together the picture frame mouldings of the present invention.

These and other objects are achieved in accordance with the invention by providing a length of picture frame moulding which includes an elongate member extending the length of the picture frame moulding. Means is carried longitudinally by the elongate member for reinforcing the elongate member against bending.

DETAILED DESCRIPTION

Figure 1:
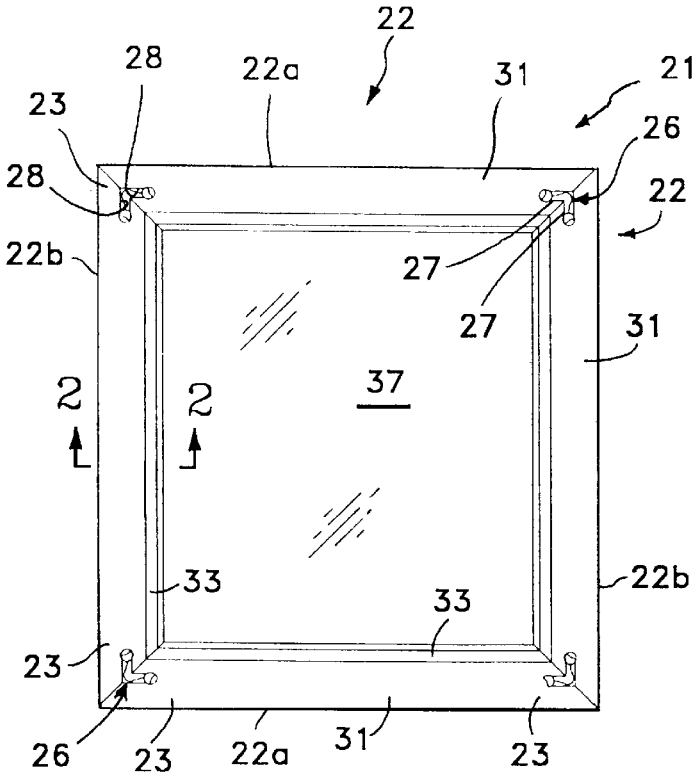
FIG. 1 is a plan view of a picture frame constructed of the picture frame moulding of the present invention.

The back of a picture frame construction or picture frame 21 incorporating a plurality of four picture frame parts or mouldings 22 of the present invention is illustrated in FIG. 1. First and second spaced-apart parallel side frame mouldings 22*a* extend at right angles to first and second spaced-apart parallel end frame mouldings 22*b*. Frame mouldings 22 have opposite end portions 23 which are mitred at approximately 45° angles and secured together by any suitable means such as conventional V-nails or wedge nails or conventional corner inserts 26. Each corner insert 26 has first and second flexible portions 27 which extend at approximately right angles to each other. Each end portion 23 is provided with routed slot 28 for receiving a flexible portion 27 of a corner insert 26. As such, corner inserts 26 are included within means for securing end portions 23 of the frame mouldings 22 together.

Figure 2:
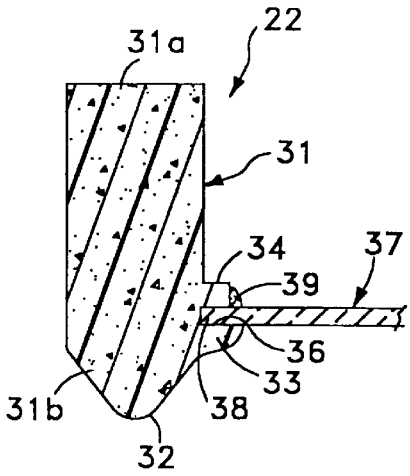
FIG. 2 is a cross-sectional view of the picture frame moulding of FIG. 1 taken along the line 2—2 of FIG. 1.

Frame mouldings 22 are each formed from an elongate member 31 extruded from any suitable plastic foam such as polyethylene, styrene or polyvinyl chloride. Elongate member 31 is artistically shaped and has an asymmetrical cross-section or profile, as illustrated in FIG. 2, which is formed without an interior bore or hole so as to be generally solid in construction. Elongate member 31 has a first or rear portion 31*a* and a second or front portion 31*b* provided with a front face 32. Front portion 31*b* is further formed with a sidewardly-extending ridge 33 which extends the length of elongate member 31 and is provided with a channel 36 extending longitudinally therealong. When frame mouldings 22 are secured together by corner inserts 26 to form picture frame 21, ridges 33 form a rabbet 34 for receiving the artwork (not shown).

Picture frame 21 further includes a sheet 37 formed from any substantially transparent material having a rigidity or stiffness greater than the material of elongate members 31. Acrylic has been found to be a suitable material for sheet 37. Planar sheet 37 serves as reinforcing means for providing rigidity to frame mouldings 22. The planar sheet 37 has a shape corresponding to that of rectangular picture frame 21 and is thus provided with four sides 38 extending at right angles to each other. The sheet 37 is sized so that one side 38 is inserted within a channel 36 of each elongate member 31. Sheet sides 38 are secured within channels 36 by any suitable means such as an adhesive or cement 39. The inner portion of ridge 33 is recessed so as to hide the adhesive or cement when viewing the framed artwork.

In operation and use, sheet 37 provides significant strength to frame mouldings 22. Since elongate member 31 and sheet 37 are made from plastics with similar coefficients of expansion, no expansion allowances need to be made and the elongate members and sheet can be bonded directly together to create an exceptionally strong assembly having negligible cold flow and sag, even in longer lengths. Sheet 37 precludes bending of the frame mouldings in directions lying in the plane of sheet 37 and also provides some strength against bending of the frame mouldings 27 in directions extending at angles to the plane of the sheet. The similar thermal coefficients of expansion also tend to minimize any separation of sheet 37 from frame mouldings 22 as a result of the expansion or contraction of picture frame 21.

Figure 4:
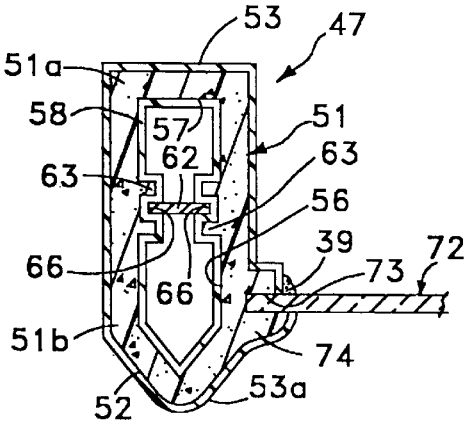
FIG. 4 is a cross-sectional view of the picture frame moulding of FIG. 3 taken along the line 4—4 of FIG. 3.
Figure 3:
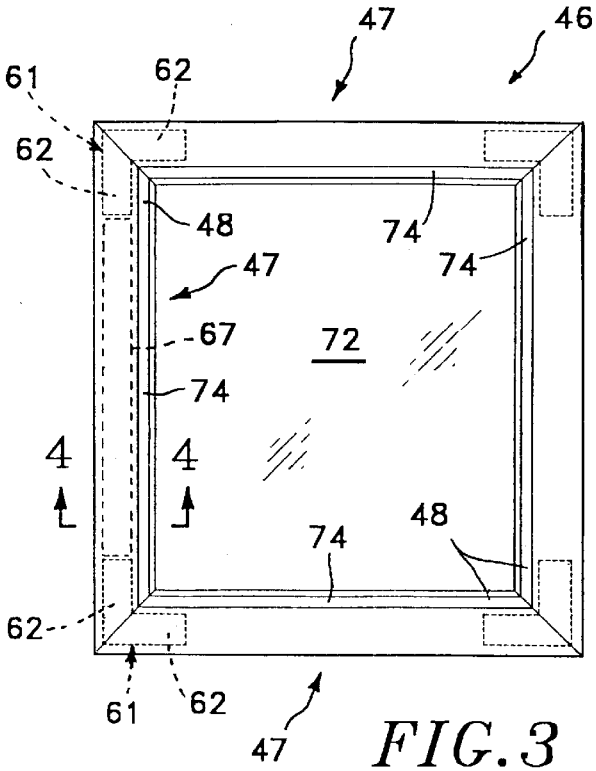
FIG. 3 is a plan view of a picture frame construction of another embodiment of the picture frame moulding of the present invention.

In another embodiment of the picture frame moulding of the present invention, a picture frame 46 is illustrated in FIG. 3 and includes a plurality of four elongate frame mouldings 47. Each of frame mouldings 47 has opposite end portions 48 cut at angles of approximately 450 so that the frame mouldings can be secured together to form a rectangular picture frame 46. Frame mouldings 47 are each formed from an elongate member 51 extruded from any suitable material such as foamed plastic. Each elongate member 51, as illustrated in FIG. 4, has an asymmetrical cross-sectional shape which is similar to the shape of elongate member 31 and includes rear and front portions 51*a* and 51*b* and an outer surface 52. A hardened skin or shell 53 made from a suitable plastic is coextruded with the elongate member 51 and thus secured to outer surface 52 thereof. Outer shell 53 forms the outer periphery of each frame moulding 47 along the length thereof and has a front portion 53*a* which forms the front face of frame moulding 47. Elongate member 51 is provided with an inner hole or bore 56 which extends longitudinally between each end portion 48 of frame moulding 47 and is formed by an inner surface 57 of the elongate member 51. An inner skin or shell 58 similar to shell 53 and coextruded simultaneously therewith and elongate member 51 extends the length of bore 56 and is secured to inner surface 57.

Means is provided for securing end portions 48 of adjacent frame mouldings 47 together to form picture frame 46. This means includes an L-shaped strip or bracket 61 having first and second end portions 62 extending at approximately right angles to each other. Brackets 61 are generally planar and made from any suitable rigid material such as plastic. Elongate members 51 are each formed with internal opposed ridges or extensions 63 which protrude into bore 56 and extend the length of the elongate member. A longitudinally-extending channel or groove 66 is provided in each extension 63. Grooves 66 are aligned relative to each other so that when frame mouldings 47 are placed together as picture frame 46, the grooves are generally in the same plane. The grooves 66 are sized and shaped to snugly receive an end portion 62 of a bracket 61 at each end of the elongate member 51. End portions 62 are secured within grooves 66 by a conventional bonding agent or cement (not shown) such as a cyanoacrylate glue.

Reinforcing means is secured to each elongate member 51 for providing rigidity to the elongate member and includes outer and inner shells 53 and 58. Substantially rigid shells 53 and 58 can each be made from a substantially solid or rigid plastic having an intrinsic rigidity or stiffness greater than the intrinsic rigidity or stiffness of the free foam material of elongate members 51. As such, outer and inner shell 53 and 58 have a bending strength which is greater than the bending strength of elongate member 51. It should be appreciated that shells 53 and 58 need not be made from the same material or have an approximately equal stiffness or rigidity and be within the scope of the present invention. The tubular configuration of shells 53 and 58 contribute to their bending strength.

Figure 5:
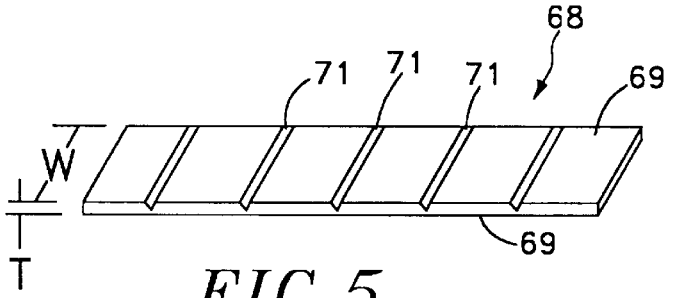
FIG. 5 is an isometric view of a strengthening strip for use in the picture frame construction of FIG. 3.

The means for providing rigidity to each elongate member 51 also includes an elongate support member in the form of strengthening strip member or strip 67 inserted into the elongate element (see FIG. 3). Strips 67 are each sized and shaped to be received within opposed grooves 66 between brackets 61 mounted to the end portions 48 of the respective frame moulding 47. Strip element or strip 67 is made from any suitable material which is stiffer than elongate members 51. For example, strip 67 can be in the form of steel pallet tape 68, a portion of which is shown in FIG. 5, having a long transverse dimension or width W and a short transverse dimension or thickness T. Pallet tape 68 has opposite first and second planar surfaces 69 and can be provided with longitudinally-spaced apart weakened portions as for example indentations or grooves 71 scored on at least one of surfaces 69.

The means for providing rigidity to elongate member 51 further includes a planar sheet 72 substantially similar to sheet 37 described above. Sheet 72 can be glued or otherwise suitably secured within a channel 73 of a ridge 74 substantially similar to channel 36 of ridge 33 described above.

In operation and use, outer and inner shells 53 and 58 strengthen elongate member 51 against the cold flow or other bending of the relatively soft nonrigid foam material forming elongate member 51. Outer shell 53 also provides a controllable surface for enhancing the aesthetic appearance of picture frame 46 and serves as a protective coating or skin which protects the outer surface of picture frame 46 from undesirable scratches and dents. Inner shell 58 creates a definable inner surface for the foam material of elongate member 51 during the extrusion of the elongate member 51. As a result, elongate member 51 can be hollow in conformation, resulting in a savings in material without loss in bending strength and rigidity. Inner shell 58 also allows acceptable tolerance control during manufacture so as to facilitate a snug fit between strengthening strip 67 and elongate member 51.

Strip 67 is sized as required from pallet tape 68 and transverse grooves 71 formed in the tape 68 provide weakenings in the tape which permit the tape to be easily dimensioned by merely bending and thus breaking the tape without the use of tools at the appropriate groove 71. It should be appreciated that tape 68 can be weakened in other manners, as for example by providing holes or perforations therein, and be within the scope of the present invention. Strip 67 and sheet 72 further add to the rigidity of frame mouldings 47 and picture frame 46. The transverse disposition of strip 67 within frame mouldings 47 so that the width of strip 67 lies in the plane of picture frame 46 provides significant strength to the frame mouldings against bending in directions extending in the plane of picture frame 46.

Although picture frame 46 has been described as including outer and inner shell 53 and 58, strip 67 and sheet 72 for providing rigidity to frame mouldings 47, it should be appreciated that the shapes and composition of these support elements and of frame mouldings 47 can adjusted so that a frame moulding 47 can be provided with less than all of the support elements. For example, a picture frame could be provided without sheet 72 and/or strip 67 and be within the scope of the present invention. Alternatively, bore 56 and inner shell 58 could be eliminated so that elongate member 51 has a solid construction, similar to that of elongate member 31 described above, with a strengthening outer shell 53.

Figure 6:
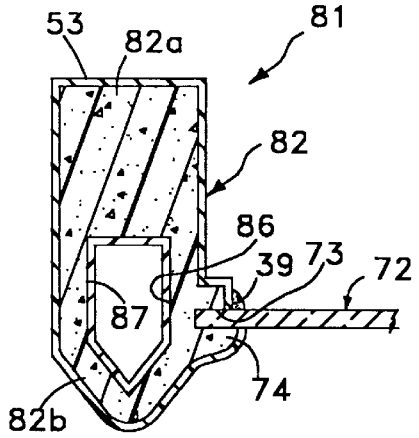
FIG. 6 is a cross-sectional view similar to FIG. 4 of another embodiment of a picture frame moulding of the present invention.

In another embodiment of the present invention, a picture frame part or moulding 81 is illustrated in FIG. 6 which is substantially similar to frame moulding 47 illustrated in FIGS. 3 and 4. Like parts in frame mouldings 47 and 81 have been identified by like reference numerals. Frame moulding 81 includes a longitudinally-extending member 82 substantially similar to elongate member 51 and having a rear portion 82*a* and a front portion 82*b*. Elongate member 82 is provided with a longitudinally-extending recess or bore 86 in front portion 82*b*. An inner shell 87 substantially similar to inner shell 58 of frame moulding 47 is secured to the inner surface of the elongate member 82 along the length thereof. Shells 53 and 87 and sheet 72 are included within the means of frame mouldings 81 for providing rigidity to elongate member 82.

Means for securing together the end portions of mouldings 81 so as to form a picture frame include routed slots (not shown) formed in rear portions 82*a* for receiving flexible corner inserts 26.

Figure 7:
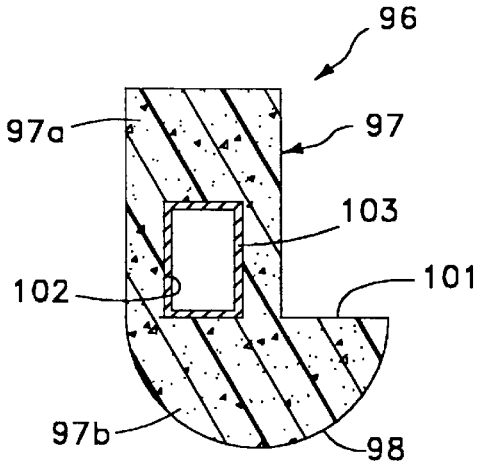
FIG. 7 is a cross-sectional view of yet another embodiment of a picture frame moulding of the present invention.
Figure 8:
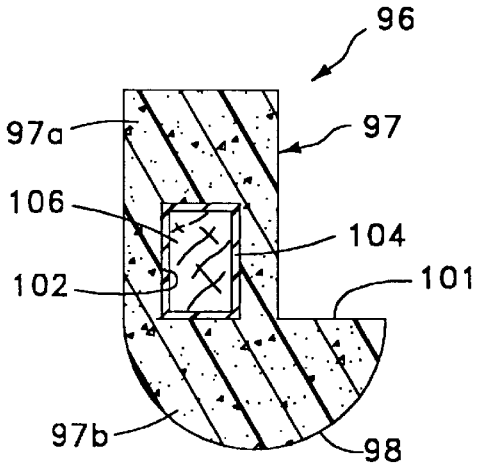
FIG. 8 is a cross-sectional view similar to FIG. 7 of a further embodiment of a picture frame moulding of the preseny invention.
Figure 9:
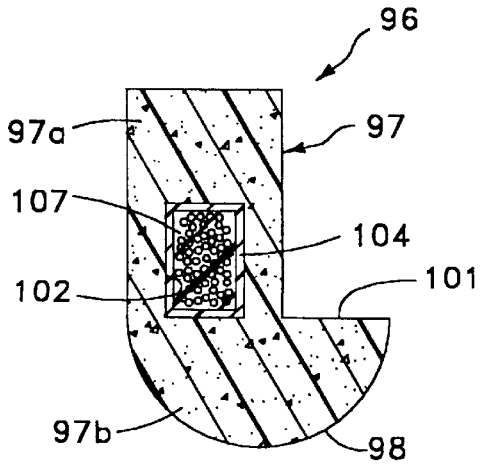
FIG. 9 is a cross-sectional view similar to FIG. 7 of another embodiment of a picture frame moulding of the present invention.

In other embodiments of the present invention illustrated in FIGS. 7–9, another profile of an elongate picture frame part or moulding 96 for constructing a picture frame is shown. Frame moulding 96 is formed from an elongate member 97 made from any suitable foamed plastic such as polyethylene, styrene or polyvinyl chloride and has a rear portion 97*a* and a front portion 97*b*. Rear portion 97*a* is generally rectangular in shape and front portion 97*b* is generally semicircular in shape and provided with an arcuate outer surface 98 which forms the front of the picture frame. Front portion 97*b* extends out from one side of rear portion 97*a* to form a rabbet 101 for receiving the artwork being placed in the picture frame. A recess or bore 102 which is rectangular in cross-section extends lengthwise through rear portion 97*a*.

Means for providing rigidity to elongate member 97 includes an elongate support member which is sized and shaped to be snugly received within bore 102 so as to be wholly concealed within the elongate member. The support member can be formed from any suitable material having a stiffness greater than the stiffness of elongate member. A metal support member 103 is illustrated in FIG. 7 which is preferably formed from steel or aluminum. Support member 103 is generally tubular or hollow in conformation and can be extruded or roll formed and is inserted into bore 102 after elongate member 97 has been extruded or otherwise formed.

In the embodiment of FIG. 8, elongate member 97 is provided with an inner shell 104 substantially similar to inner shell 58 and made from any suitable material such as plastic having an intrinsic stiffness greater than the intrinsic stiffness of elongate member 97. A support member 106 is provided which is sized and shaped the same as support member 103 but is made from another relatively stiff material such as wood. Support member 106 is inserted into bore 102 in substantially the same manner as support member 103 discussed.

The support member can also be a pulltrusion. Such a support member 107 is illustrated in FIG. 9.

In operation and use of frame moulding 96, support members 103, 106 and 107 provide significant strength to the picture frames against bending in directions lying in the plane of the picture frame formed thereby and in directions extending at an angle to the plane of the picture frame. Inner shell 104 illustrated in FIGS. 8 and 9 adds further stiffness to elongate member 97 and provides a large hardened surface area for supporting the support member 106 or 107 within the elongate member. It should be appreciated, however, that an elongate member 97 having no inner strengthening shell, such as illustrated in FIG. 7, can be provided and be within the scope of the present invention.

Figure 10:
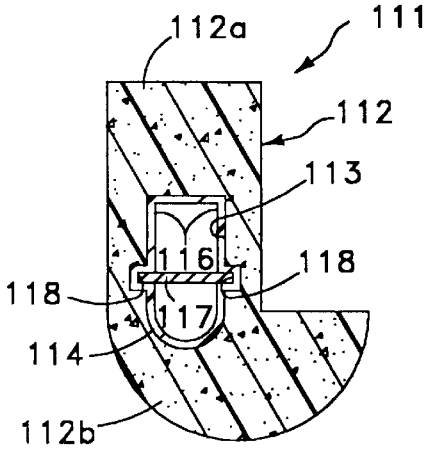
FIG. 10 is a cross-sectional view similar to FIG. 7 of an additional embodiment of a picture frame moulding of the present invention.

In yet another embodiment, a picture frame part or frame moulding 111 is provided which is formed with an elongate member 112 substantially similar to elongate member 97 (see FIG. 10). The elongate member 112 has a rear portion 112*a* and a front portion 112*b* and is provided with a bore 113 which extends longitudinally through the elongate member. An inner shell 114 substantially similar to inner shell 58 is formed on the inside of the elongate member 112 and extends along the length of the bore 113. Bore 113 has a cross-sectional size which is larger than the cross-sectional size of bore 102 of elongate member 97 and inner shell 114 therein is provided with parallel, opposed side surfaces 116.

Means for providing rigidity to elongate member 112 includes a strip 117 which is substantially similar to strip 67 and is inserted inside of the elongate member 112. A pair of opposed grooves 118 are formed in side surfaces 116 for fastening strip 117 inside elongate member 112 after the elongate member has been extruded or otherwise formed. Reinforcing strip 117 is disposed close to the center of elongate member 112 so as to enhance its strengthening of the elongate member.

Figure 11:
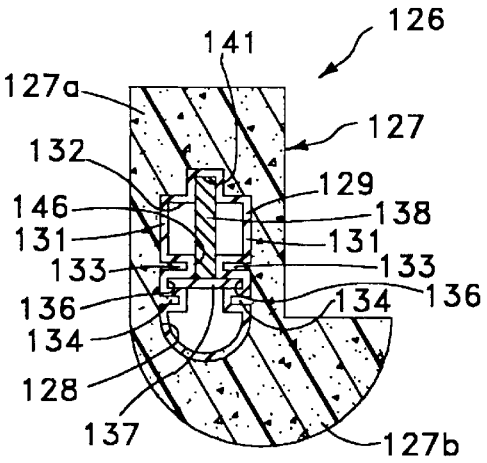
FIG. 11 is a cross-sectional view similar to FIG. 7 of yet a further embodiment of a picture frame moulding of the present invention.

The picture frame moulding of the present invention can have more than one support strip extending longitudinally therethrough and be within the scope of the present invention. In this regard, a frame moulding 126 is shown in FIG. 11 which is formed with an elongate member 127 substantially similar to elongate member 112. Elongate member 127 has a rear portion 127*a* and a front portion 127*b*. A bore 128 substantially similar to bore 113 extends through the elongate member 127 and an inner shell 129 substantially similar to inner shell 58 discussed above is secured to the inside of elongate member 127. The inner shell 129 is formed with opposed side surfaces 131 and an end surface 132 which joins the side surfaces 131 at right angles. Spaced-apart first and second ridges 133 and 134 extend outwardly from each of side surfaces 131 at approximately right angles. Each pair of ridges 133 and 134 forms a first groove 136 in the respective side surface 131 which extends longitudinally along the inside of the elongate member 127.

A first reinforcing strip 137 substantially similar to strip 67 is snugly disposed within securing means in the form of grooves 136 so that when viewed in cross section, as illustrated in FIG. 11, the strip extends transversely across bore 128 between side surfaces 131. A second reinforcing strip 138 is carried within the elongate member 127 and is disposed at an approximately right angle to first strip 137. Means for securing second strip 138 within elongate member 127 includes a second groove 141 formed in the center of end surface 132 and aligned at approximately right angles to grooves 136. Second strip 138 has one side disposed within third groove 141 and the opposite side butted up against the center of first strip 137. First ridges 133 extend alongside the first strip 137 so as to abut the second strip. In this manner, first ridges 133 and first strip 137 form a fourth groove 146 for receiving the second side of strip 138.

As discussed above, first strips 137 provide strength to frame mouldings 126 against bending in directions lying in the plane of the picture frame formed by the frame mouldings 126. Second strips 138 serve to provide strength to the frame mouldings 126 against bending in directions lying at an angle to the plane of the picture frame. Together, strips 137 and 138 provide rigidity to the respective frame moulding 126 similar to that provided by support members 103, 106 and 107 to frame moulding 96.

Figure 12:
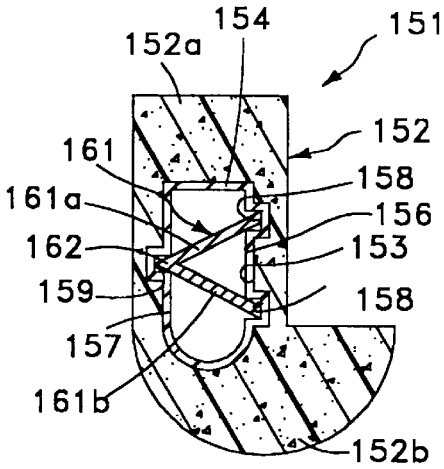
FIG. 12 is a cross-sectional view similar to FIG. 7 of another embodiment of a picture frame moulding of the present invention.

First and second reinforcing strips can also be provided which are formed integral with each other as illustrated in FIG. 12. As shown therein, a frame moulding 151 is provided which is substantially similar to frame moulding 111 and formed with an elongate member 152 substantially similar to elongate member 112. Elongate member 152 has a rear portion 152*a* and a front portion 152*b*. A bore 153 substantially similar to bore 113 extends longitudinally through the elongate member 152 and an inner shell 154 substantially similar to inner shell 58 is secured to the inside of the elongate member and extends along the length of bore 153. Inner shell 154 is formed from spaced-apart, parallel first and second side surfaces 156 and 157 which extended at approximately right angles to the plane of the picture frame formed by framed parts 151. First side surface 156, which is closer to the center of the picture frame than second side surface 157, is provided with spaced-apart grooves 158 which extend longitudinally along the length of surface 156. Second side surface 157 is provided with a single groove 159 extending along the length thereof and disposed approximately midway between opposed grooves 158.

A substantially rigid support or reinforcing member 161 made from the same material as strip 67 is disposed within bore 153. Support member 161, as illustrated in FIG. 12, is generally V-shaped in cross-section and formed from first and second strip portions 161*a* and 161*b* which join at an apex 162. First strip portion 161*a* is disposed at an angle with respect to second strip portion 161*b* and, as illustrated in the drawings, strip portions 161*a* and 161*b* are disposed at an oblique angle relative to each other. Support member 161 is slidably inserted within elongate member 152 so that apex 162 is received within groove 159 and the free ends of strip portions 161*a* and 161*b* are received within respective grooves 158. The V-shaped cross-section of support member 161 provides significant rigidity to frame moulding 151 against bending about the transverse axes of the frame moulding. The triangular shape of support member serves to increase the torsional rigidity of the frame mouldings 151.

Figure 13:
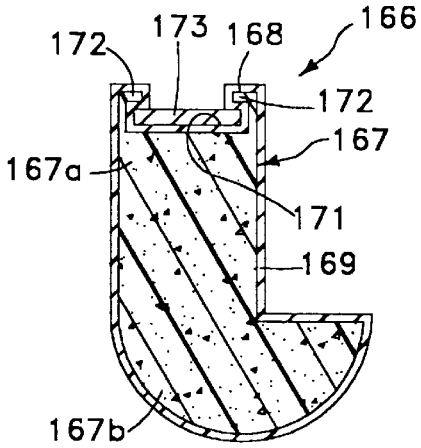
FIG. 13 is a cross-sectional view similar to FIG. 7 of yet an additional embodiment of a picture frame moulding of the present invention.

A support strip can be mounted on the outside of the picture frame moulding and be within the scope of the present invention. For example, as illustrated in FIG. 13, a frame moulding 166 can be provided which includes an elongate member 152 substantially similar to elongate member 97 but formed without an internal bore so as to be generally solid in cross-section. Elongate member 167 has a rear portion 167*a* and a front portion 167*b*. Frame moulding 166 has a rear surface 168. A recess 171 is provided in rear portion 167*a* and has a narrowed opening extending through rear surface 168 which is formed by opposed ridges 172. An outer shell 169 substantially similar to outer shell 53 discussed above is secured to the outside of elongate member 167 and extends within recess 171. A strip 173 substantially similar to strip 67 is slidably inserted within recess 171 so as to extend along the length of elongate member 167. Ridges 172 serve to retain the strip 173 within recess 171. Planar strip 173 is aligned relative to elongate member 167 such that the strip lies within the plane of the picture frame formed by frame mouldings 166.

Strip 173 provides rigidity to the frame in a manner similar to strips 67, 117 and 137 described above. Outer shell 169 serves to stiffen and provide a controllable outer surface to elongate member 167 as discussed above. It should be appreciated, however, that a frame moulding similar to frame moulding 166 can be provided without a reinforcing outer shell and be within the scope of the present invention.

Figure 14:
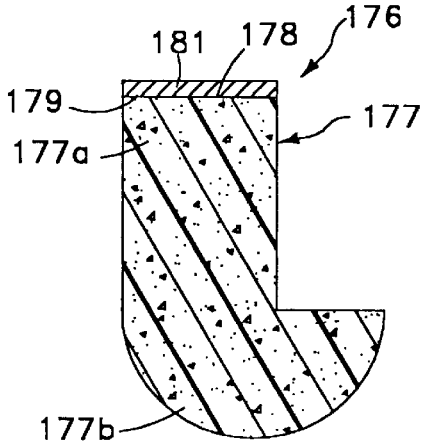
FIG. 14 is a cross-sectional view similar to FIG. 7 of a further embodiment of a picture frame moulding of the present invention.

In another embodiment of the invention, a frame moulding 176 is provided that includes an elongate member 177 substantially similar to elongate member 167 (see FIG. 14). Elongate member 177 has a rear portion 177*a* 10 and a front portion 177*b*. Rear portion 177*a* includes a rear surface 178. Reinforcing means for providing rigidity to elongate member 177 include a strip 181 substantially similar to strip 67 described above which is affixed to rear surface 178 by any suitable means such as an adhesive 179. Strip 181 serves to provide support to elongate member 177 in the same manner in which strip 173 supports elongate member 167. It should be appreciated that a frame moulding provided with an outer reinforcing shell could have an externally affixed strip as with frame moulding 176 and be within the scope of the present invention.

Figure 15:
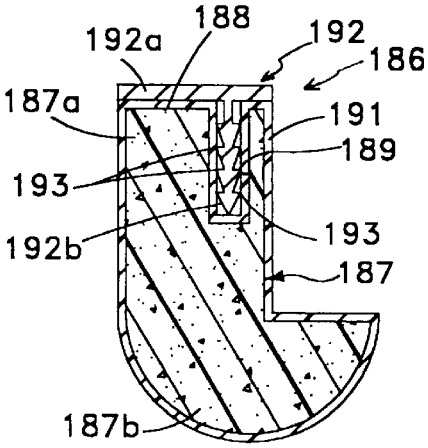
FIG. 15 is a cross-sectional view similar to FIG. 7 of yet another embodiment of a picture frame moulding of the present invention.

An externally mounted strip can also be provided which provides support to the frame mouldings of a picture frame against bending in directions lying at an angle to the picture frame. A frame moulding 186 incorporating such a strip is illustrated in FIG. 15. Frame moulding 186 includes an elongate member 187 substantially similar to elongate member 167 and having a rear portion 187*a* and a front portion 187*b*. Rear portion 187*a* is formed in part by a rear surface 188. A recess 189 extends longitudinally along the length of rear portion 187 and extends inwardly from rear surface 188 at an approximately right angle.

A first reinforcing element in the form of outer shell 191 substantially similar to outer shell 53 is formed on the outside of the elongate member 187 and extends into recess 189. A second reinforcing element in the form of support member 192 is provided which includes a first or strip portion 192*a* and a second portion or extension 192*b* which extends from strip portion 192*a* at an approximately right angle. Integral extension 192*b* has a plurality of barbs 193 extending from each of its opposite sides so as to have a profile similar to that of a Christmas tree. Extension 192*b* and recess 189 are relatively sized so that the extension 192*b* can be pressed into recess 189 and barbs 193 engage the sidewalls of outer shell 191 within recess 189 to inhibit withdrawal of the extension. Once extension 192 is so mounted within recess 189, strip portion 192*a* of support member 192 lies generally flush against rear surface 188 member 187. Strip portion 192*a* supports elongate member 187 in a manner similar to strips 67, 117, 137, 173 and 181 described above, while extension 192*b* provides support to the elongate member 187 against bending in directions at an angle to the plane of the picture frame in a manner similar to strip 138 described above. It should be appreciated that recess 189 could be formed with ridges (not shown) for cooperatively mating with barbs 193 and assisting in the securement of support member 192 to elongate member 187. It should be further appreciated that frame moulding 186 can be formed without outer shell 191 and be within the scope of the present invention.

Figure 16:
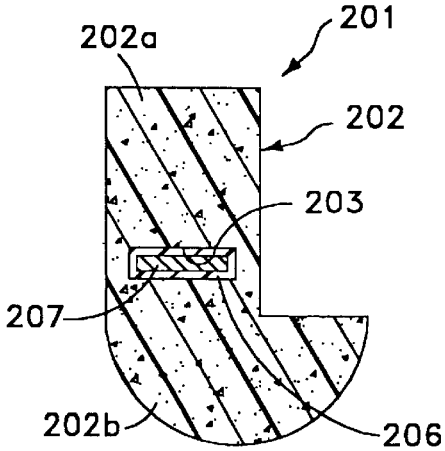
FIG. 16 is a cross-sectional view similar to FIG. 7 of yet a further embodiment of a picture frame moulding of the present invention.

In a further embodiment, a picture frame moulding 201 is illustrated in FIG. 16 which includes an elongate member 202 substantially similar to elongate member 97. The elongate member 202 has a rear portion 202*a* and a front portion 202*b* and is provided with a bore 203 which extends longitudinally through the elongate member. Bore 203 is generally rectangular in cross-section. An inner shell 206, substantially similar to inner shell 58, is secured to the inside of elongate member 202 and extends the length of bore 203. The inner shell 206 serves as first means for reinforcing elongate member 202 against bending. Second means for reinforcing elongate member 202 is in the form of a strip 207 substantially similar to strip 67. The strip 67 is inserted within bore 203 and is snugly received by inner shell 206.

In operation and use, inner shell 206 and strip 207 reinforce elongate member 202 against cold flow and other bending. The transverse disposition of strip 207 so that the width of strip 207 lies in the plane of the picture frame provides significant strength to frame moulding 201 against bending in directions extending in the plane of the picture frame.

It should be appreciated from the foregoing that other embodiments of the novel picture frame moulding of the present invention can be provided which incorporate one or more of the reinforcing means described above for providing stiffness to an elongate member of a picture frame. It should also be appreciated that the shell, strip, sheet or other reinforcing member can be made from other materials not specifically discussed above. In general, the reinforcing or support member should be made from a material which is stiffer than the material from which the elongate member is made. The relatively rigid support member thus serves to strengthen the elongate member against bending and, when the elongate member is made from a foamed plastic, against cold flow.

Figure 17:
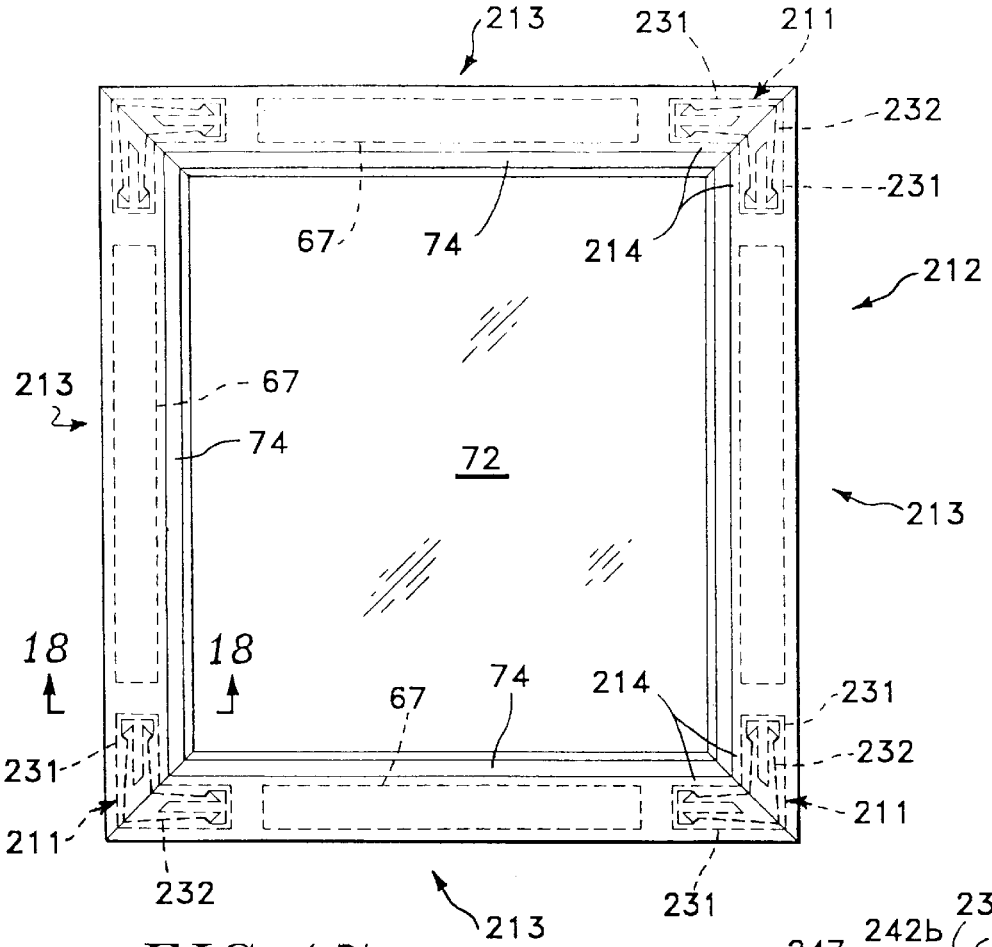
FIG. 17 is a plan view of a picture frame construction, similar to the picture frame construction of FIG. 3, in which the picture frame moulding is secured together by the corner assembly of the present invention.
Figure 18:
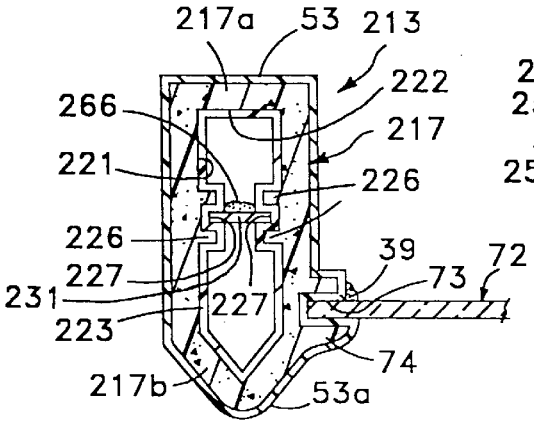
FIG. 18 is a cross-sectional view of the picture frame moulding of FIG. 17 taken along the line 18—18 of FIG. 17.
Figure 19:
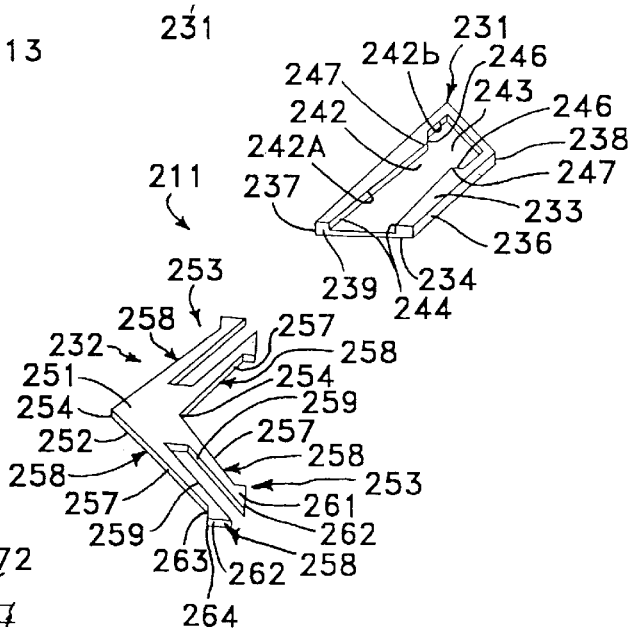
FIG. 19 is an isometric view of the corner assembly of FIG. 17.

Although means for securing together the frame mouldings of the present invention have been described above as including corner inserts 26 and brackets 61, it should be appreciated that other means can be utilized for securing together the frame mouldings and be within the scope of the present invention. For example, a locking corner assembly 211 for securing together the picture frame moulding of the present invention is illustrated in FIGS. 17–19. A picture frame construction or picture frame 212 is provided which is substantially similar to picture frame 46 illustrated in FIG. 3. Picture frame 212 is constructed of four frame mouldings 213 extending at right angles to each other.

Longitudinally-extending frame mouldings 213 are substantially similar to frame mouldings 47 of picture frame 46 and like reference numbers are used to describe like components therein. Frame mouldings 213 each have opposite end portions 214 and are formed from an elongate member 217 substantially similar to elongate member 51. Elongate members 217, as shown in FIG. 18, each include rear and front portions 217*a* and 217*b* and an outer surface 218. Hardened shell 53 is secured to outer surface 218. Elongate member 217 is provided with an inner hole or bore 221 formed by inner surface 222. An inner skin or shell 223 substantially similar to shell 58 is secured to the inner surface 222 and extends the length of bore 221. Plastic shells 58 and 223 can be coextruded with the foam material of elongate member 217 to form frame moulding 213 in substantially the same manner as discussed above with respect to frame mouldings 47.

Means is provided for securing together end portions 214 of adjacent frame mouldings and includes internal opposed ridges or extensions 226 formed in elongate members 217. Extensions 226 are substantially similar to extensions 63 but have larger transverse dimensions than extensions 63 so as to almost abut each other within bore 221. The extensions 226 are each provided with longitudinally-extending channels or grooves 227 substantially similar to grooves 66.

Locking corner assemblies 211 are included within the means for securing together end portions 214 of frame mouldings 213. Each corner assembly 211, as illustrated in FIG. 19, includes a generally planar locking receptacle member or receptacle 231 and a generally planar locking corner insert or bracket 232 each made from any suitable material such as polycarbonate, impact modified styrene or acrylic. Receptacle 231 is formed with opposite first and second planar surfaces 233 and 234 which extend in directions generally parallel to each other, opposite first and second side surfaces 236 and 237 which extend parallel to each other and at right angles to the surfaces 233 and 234, a first planar end surface 238 extending at right angles to surfaces 233, 234, 236 and 237 and an opposite second planar end surface 239 extending at right angles to surfaces 233 and 234 and at approximately 450 angles to surfaces 236 and 237.

A recess or socket 242 is provided in locking receptacle 231 and extends through first surface 233. Socket 242 is formed in part by an inner planar surface 243 extending parallel to surface 233 and has a first or narrowed portion 242*a* and a second or enlarged end portion 242*b*. Narrowed portion 242*a* is formed by opposed inner side surfaces 244 which extend from second end surface 239 toward first end surface 238. Planar side surfaces 244 incline inwardly as they approach enlarged end portion 242*b*. The socket end portion 242*b* is formed in part by planar side surfaces 246 which splay outwardly from inner side surfaces 244 toward respective outer side surfaces 236 and 237. Surfaces 244 and 246 each extend at generally right angles from inner surface 243. Respective inner side surfaces 244 and 246 meet to form a ridge 247.

Each corner bracket 232 includes opposite first and second planar surfaces 251 and 252 which extend in directions generally parallel to each other and has first and second locking portions or slides 253 which extend from inner and outer corners 254 at approximately right angles to each other. Each prong member or slide 253 is formed in part by opposite planar side surfaces 257 which extend at right angles to surfaces 251 and 252 and inwardly toward each other as they extend from corners 254. Side surfaces 257 form the outer surface of first and second spaced-apart tine elements or tines 258. Opposed planar surfaces 259 form the respective inner surfaces of tines 258 and extend in directions generally parallel to each other and at right angles to inner surfaces 259 of the other tine 258 of locking corner bracket 232. Each tine 258 has an enlarged end portion 261 formed from a planar forward surface 262 extending rearwardly at an acute angle relative to inner surface 259 and a planar locking surface 263 which extends at an approximately right angle from surface 262 toward inner surface 259 so as to join the respective side surface 257. Surfaces 262 and 263 of each tine 285 join at a corner 264.

A locking receptacle 231 is inserted inside each end portion 214 of a frame moulding 213 included within picture frame 212. Each locking receptacle 231 is slid into the ends of a pair of opposed grooves 227 until, as illustrated in FIGS. 17 and 18, inclined end surface 239 of the locking receptacle is generally adjacent with the inclined end surface of the end portion 214. The locking receptacle 231 and grooves 227 are cooperatively sized and shaped so that the locking receptacle is snugly received within the grooves. Any conventional bonding agent or cement such as a cyanoacrylate glue 266 can be used for permanently securing locking receptacle 231 within the respective end portion 214. It should also be appreciated that locking barbs similar to those disclosed above can be provided in grooves 227 of elongate member 217 and/or side surfaces 236 of locking receptacle 231 for securing the locking receptacles to frame mouldings 213 and be within the scope of the present invention.

In operation and use, locking corner assembly 211 serves to secure together respective end portions 214 of adjoining frame mouldings 213, either separately or together with a conventional bonding agent or glue. If such a glue is used, it is first applied to end portions 214 and locking corner brackets 232 are then utilized to rigidly and snugly secure respective end portions 214 together while the glue cures. In this regard, locking slides 253 of the corner brackets are inserted into respective locking receptacles 231. During insertion, forward surfaces 262 of tines 258 engage inner side surfaces 244 to cause the tines to bend toward each other as opposite corners 264 slide along the inner side surfaces 244. Tines 258 are spaced apart a sufficient distance to permit opposite corners 264 to pass opposed ridges 247. Once within portion 242*b* of the receptacle socket 242, enlarged end portions 261 of tines 258 snap outwardly back to their home position and serve to preclude the dislodging of locking slides 253 from receptacle sockets 242. As such, enlarged end portions 261 of tines 258 and enlarged portions 242*b* of receptacle socket 242 are included within the cooperative mating means of corner assembly 211 for securing locking slides 253 within sockets 242 with a snap fit. Further in this regard, locking and side surfaces 263 and 257 of locking slides 253 are sized and shaped to cooperatively mate with side surfaces 246 and 242 of locking receptacle 231, as shown in FIG. 17, and thus provide a snug fit between the locking slides and receptacles.

Should it be necessary to separate end portions 214 of adjoined frame mouldings 213 when a glue has not been utilized, locking slides 253 can be removed from sockets 242. Inclined side surfaces 246 of the locking receptacle 231 and the cooperatively engaging inclined locking surfaces 263 of the locking slides 253 cause tines 258 to bend inwardly toward each other and permit corners 263 to move out of the enlarged end portion 242*b* of socket 242 past ridges 247.

As can be seen, locking receptacles 231 can be inserted into the frame mouldings as part of the manufacture process. Picture frames 212 can then be easily assembled by merely inserting locking slides 253 into the sockets 242 of the locking receptacles. In this manner, locking corner assemblies 211 permit the securing together of frame mouldings 213 without the use of glue or adhesives and facilitate the disassembly of the picture frame 212 if desirable. Alternatively, corner assemblies 211 can be used with glue to secure together frame mouldings 212 as the glue cures and dries. It should be appreciated that other embodiments of corner assemblies having corner inserts which snap fit or otherwise secure to the end portions of frame mouldings can be provided and be within the scope of the present invention.

In view of the foregoing, it can be seen that a new and improved picture frame moulding has been provided which is competitive in price and comparable in strength to many conventional wood mouldings. The picture frame moulding includes an elongate member which can be extruded from a foam material. A reinforcing element is carried by the elongate member along the length thereof for increasing the stiffness of the picture frame moulding. In one embodiment, the reinforcing element can include a shell secured to the outside of the elongate member. In another embodiment, the elongate member can be hollow and the reinforcing element member can include a shell secured to the inside of the elongate member. In a further embodiment, the reinforcing element includes a metal strip. The metal strip can be carried inside the elongate member. A reinforcing element can be provided which strengthens the elongate member against bending about the transverse axes of the elongate member. A corner assembly has been provided for easily securing together the picture frame mouldings of the present invention.

It is claimed:

1. A frame construction comprising a plurality of lengths of moulding, each of the lengths of moulding having first and second opposite end portions and formed from an elongate core member of a foamed material, the elongate core member having a longitudinal axis and a length and a width and a ratio of length to width of at least three to one, the elongate core member having an outer surface extending about the longitudinal axis the length of the elongate core member, and a seamless shell of a plastic material less flexible than the foamed material disposed around the outer surface over the length of the elongate core member for reinforcing the elongate core member against bending and fastening means for securing together the first and second end portions of the lengths of moulding into a unitary framework defining a central opening.

2. A frame construction as in claim 1 wherein each elongate core member is asymmetrical in cross-section.

3. A frame construction as in claim 1 wherein at least one of the elongate core members has a ratio of length to width of at least five to one.

4. A frame construction as in claim 1 wherein at least one of the elongate core members is hollow and includes an inner surface, a shell made of a plastic material less flexible than the foamed material disposed on the inner surface over the length of the elongate core member.

5. A frame construction as in claim 1 further comprising a substantially rigid strip member, means for securing the strip member to at least one of the elongate core members for further strengthening the elongate core member against bending.

6. A frame construction as in claim 5 wherein the means for securing the strip member to the elongate core member includes means for securing the strip member to the outer surface of the elongate core member.

7. A frame construction as in claim 6 wherein the means for securing the strip member to the outer surface of the elongate core member includes barbs extending outwardly from the strip member into the elongate core member.

8. A frame construction as in claim 5 wherein the elongate core member is formed with a longitudinally-extending recess for receiving the strip member.

9. A frame construction as in claim 5 wherein the elongate core member is hollow and the strip member extends inside of the elongate core member.

10. A frame construction as in claim 9 further comprising an additional strip member extending inside the elongate core member and disposed at an angle to the first named strip member for providing additional rigidity to the elongate core member.

11. A frame construction as in claim 10 wherein the additional strip member is disposed at a right angle to the first named strip member.

12. A frame construction as in claim 10 wherein the additional strip member is formed integral with the first named strip member.

13. A frame construction as in claim 10 wherein the additional strip member is disposed at an oblique angle to the first named strip member.

14. A frame construction as in claim 5 wherein the strip member is made from metal.

15. A frame construction as in claim 5 wherein the strip member is formed with first and second opposite planar surfaces and wherein at least one of the surfaces is provided with a plurality of longitudinally spaced-apart weakened portions, each weakened portion extending transversely across the surface for facilitating breaking of the strip member at the weakened portion.

16. A frame construction as in claim 1 wherein at least one of the elongate core members is provided with a bore extending longitudinally therethrough, a support member of a material less flexible than the foamed material snugly received within the bore for reinforcing the elongate core member against bending.

17. A frame construction as in claim 16 wherein the support member is tubular in conformation and made from metal.

18. A frame construction as in claim 16 wherein the support member is made from wood.

19. A frame construction as in claim 16 wherein the support member is a pulltrusion.

20. A frame construction as in claim 16 wherein the support member is a strip member of metal.

21. A frame construction comprising a plurality of lengths of moulding, each of the lengths of moulding having first and second opposite end portions and formed from an elongate core member of a foamed plastic, the elongate core member having a longitudinal axis and a length and a width and a ratio of length to width of at least three to one, a circumferentially seamless shell of a plastic material less flexible than the foamed plastic secured to the elongate core member, a strip member of a material which is substantially rigid relative to foamed plastic, securing means for securing the strip member to the seamless shell for reinforcing the elongate core member against bending and fastening means for fastening together the first and second end portions of the lengths of moulding into a unitary framework defining a central opening.

22. A frame construction as in claim 21 wherein the strip member is made from metal.

23. A frame construction as in claim 21 wherein the strip member has opposite first and second planar surfaces, the securing means including barbs extending from one of the surfaces for insertion into the elongate core member.

24. A frame construction comprising a plurality of lengths of moulding, each of the lengths of moulding having first and second opposite end portions and having an elongate core member of a first extruded material and a circumferentially seamless shell of a second extruded material less flexible than the first extruded material secured to the elongate core member and extending the length of the elongate core member for reinforcing the elongate core member against bending, and fastening means for securing together the first and second end portions of the lengths of moulding into a unitary framework defining a central opening.

25. A frame construction as in claim 24 wherein each elongate core member has an outer surface, the shell being secured to the outer surface of the elongate core member.

26. A frame construction as in claim 24 wherein the elongate core member is asymmetrical in cross-section.

27. A frame construction as in claim 24 further comprising a substantially rigid strip member, means for securing the strip member to the elongate core member for further strengthening the elongate core member against bending.

28. A frame construction as in claim 24 wherein each of the elongate core members has a longitudinal axis, the first and second end portions having an end surface disposed at an oblique angle to the longitudinal axis of the elongate core member.

29. A frame construction comprising a plurality of lengths of moulding, each of the lengths of moulding having first and second opposite end portions and formed from an elongate core member of a first extruded plastic material, the elongate core member having a length and a width and a ratio of length to width of at least three to one, the elongate core member having a longitudinal axis and an outer surface extending along the longitudinal axis the length of the elongate core member, a circumferentially seamless shell of a second extruded plastic material less flexible than the first extruded plastic material secured to the outer surface of the elongate core member and extending the length of the elongate core member for reinforcing the elongate core member against bending and fastening means for securing together the first and second end portions of the lengths of moulding into a unitary framework defining a central opening.

30. A frame construction as in claim 29 further comprising a strip member of a material less flexible than the first and second extruded plastic materials, securing means for securing the strip member to at least one of the elongate core members for providing rigidity to the elongate core member.

31. A frame construction as in claim 30 wherein the elongate core member is provided with a recess, the securing means including barbs extending outwardly from the strip member for insertion into the recess of the elongate core member.

32. A picture frame construction comprising first and second spaced-apart parallel side lengths of moulding, first and second spaced-apart parallel end lengths of moulding and means for fastening together the first and second side lengths of moulding and the first and second end lengths of moulding into a unitary rectangular framework, each of the first and second end lengths of moulding and each of the first and second side lengths of moulding including an elongate core member of a foamed material with a longitudinal axis and first and second end portions, the elongate core member having a length and a width and a ratio of length to width of at least three to one and having an outer surface extending about the longitudinal axis the length of the elongate core member, a seamless shell of a plastic material less flexible than the foamed material disposed around the outer surface over the length of the elongate core member for reinforcing the elongate core member against bending.

33. A picture frame construction as in claim 32 further comprising a strip member of a material less flexible than the foamed material carried by each elongate core member longitudinally of the elongate core member for providing additional rigidity to the elongate core member.

34. A picture frame construction as in claim 32 wherein each elongate core member has a longitudinally-extending inner surface, a seamless shell of a plastic material less flexible than the foamed material secured to the inner surface of the elongate core member.

* * * * *